US011753954B2

(12) United States Patent
Korepin et al.

(10) Patent No.: US 11,753,954 B2
(45) Date of Patent: Sep. 12, 2023

(54) COMPRESSOR TO MINIMIZE VANE TIP CLEARANCE AND GAS TURBINE INCLUDING THE SAME

(71) Applicant: DOOSAN ENERBILITY CO., LTD, Changwon (KR)

(72) Inventors: Oleksiy Korepin, Gimhae (KR); Ievdoshyn Andrii, Gimhae (KR); Dong Woo Ham, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/161,890

(22) Filed: Jan. 31, 2023

(65) Prior Publication Data

US 2023/0250729 A1 Aug. 10, 2023

(30) Foreign Application Priority Data

Feb. 7, 2022 (KR) ..... 10-2022-0015704

(51) Int. Cl.
*F01D 5/20* (2006.01)
*F01D 11/00* (2006.01)

(52) U.S. Cl.
CPC ..... *F01D 11/001* (2013.01); *F05D 2220/32* (2013.01); *F05D 2240/11* (2013.01); *F05D 2260/20* (2013.01)

(58) Field of Classification Search
CPC ..... F01D 25/246; F05D 2220/32; F05D 2240/11; F02C 3/04
USPC ..... 415/173.1
See application file for complete search history.

(56) References Cited

U.S. PATENT DOCUMENTS

| | | | | |
|---|---|---|---|---|
| 7,445,426 | B1 * | 11/2008 | Matheny | F01D 9/042 415/209.1 |
| 8,398,366 | B2 | 3/2013 | Twell | |
| 9,835,171 | B2 | 12/2017 | Kimmel | |
| 10,641,118 | B2 * | 5/2020 | Ikeda | F16J 15/08 |
| 2014/0017060 | A1 * | 1/2014 | Duong | F01D 11/22 415/173.2 |
| 2018/0347586 | A1 | 12/2018 | Kwak | |
| 2019/0226347 | A1 * | 7/2019 | Kwak | F01D 5/3038 |
| 2022/0082025 | A1 * | 3/2022 | Todo | F01D 25/30 |

* cited by examiner

*Primary Examiner* — Long T Tran
*Assistant Examiner* — James J Kim
(74) *Attorney, Agent, or Firm* — Harvest IP Law, LLP

(57) ABSTRACT

Disclosed are a compressor, which is a cantilever type that is easy to manufacture and assemble, and is capable of minimizing the vane tip clearance as the elastic member absorbs the impact and is compressed when the vane collides with the shroud segment due to expansion of the vane, and a gas turbine including the same.

18 Claims, 3 Drawing Sheets

COMPRESSOR TO MINIMIZE VANE TIP CLEARANCE AND GAS TURBINE INCLUDING THE SAME

CROSS REFERENCE TO RELATED APPLICATION

The present application claims priority to Korea Patent Application No. 10-2022-0015704, filed on Feb. 7, 2022, the entire contents of which is incorporated herein for all purposes by this reference.

TECHNICAL FIELD

The present disclosure relates to a compressor and a gas turbine including the same, and more particularly, to a compressor capable of minimizing a vane tip clearance, and a gas turbine including the same.

BACKGROUND

Generally, a turbine is a machine which converts energy of a fluid such as water, gas, or steam into mechanical energy. Typically, a turbo machine, in which a plurality of feathers or wings are embedded around a circumferential portion of a rotating body so that the rotating body is rotated at a high speed by impulsive force or reactive force generated by discharging steam or gas to the feathers or wings, is referred to as a turbine.

Such turbines are classified into a water turbine using energy of water located at a high elevation, a steam turbine using energy of steam, an air turbine using energy of high-pressure compressed air, a gas turbine using energy of high-temperature/high-pressure gas, and so forth.

In general, a gas turbine is a kind of internal combustion engine that converts thermal energy into mechanical energy by injecting high-temperature, high-pressure combustion gas generated by mixing fuel with air compressed at high pressure in a compressor and then combusting a mixture of the fuel and air to a turbine to rotate it. Gas turbines are used to drive generators, aircraft, ships and trains.

Since these gas turbines do not have a reciprocating movement mechanism such as a piston of a 4-stroke engine, there is no mutual friction portion such as a piston-cylinder. Therefore, the consumption of lubricating oil is extremely low, the amplitude which is a characteristic of a reciprocating movement mechanism is greatly reduced, and high-speed movement is possible.

A gas turbine includes, as basic elements, a compressor to compress air, a combustor to combust compressed air supplied from the compressor with fuel to produce combustion gas; and a turbine to rotate wings by high-temperature and high-pressure combustion gas injected by the combustor to generate power. The combustion gas injected into the turbine generates rotational force while passing through the turbine vanes and turbine blades, thereby rotating the rotor of a turbine.

The compressor includes a plurality of compressor blades and a plurality of compressor vanes arranged alternately, and compressor blades rotate with a rotor (rotating shaft) of the gas turbine, while compressor vanes are installed on a compressor casing to align the flow of air drawn into the compressor blades.

At this time, the compressor vane may be a shrouded type like a vane 170 shown in Korean Patent No. 10-2026827, or a cantilever type like a retaining ring 200 and a vane 300 shown in Korean Patent Application Publication No. 10-2018-0130786.

The shrouded type of a compressor vane may be provided with retaining rings on both an outside and an inside of the vane in a radial direction, and the shrouded type may make the vane tip clearance zero. Therefore, the shrouded type may eliminate a leakage flow caused by the tip clearance, but it has a disadvantage of increasing manufacturing cost and time.

The cantilever type may be provided with a retaining ring only on an outside of the vane in a radial direction, and the cantilever type is easier to manufacture and assemble than the shrouded type. However, there is a disadvantage that a leakage flow may occur, because a clearance of a certain value is required to prevent a collision due to a difference in the internal structure caused by thermal expansion during operation.

SUMMARY

One of the aims of the present disclosure is to provide a cantilever type compressor that is easy to manufacture and assemble, but can minimize the vane tip clearance and a gas turbine including such cantilever type compressor. The aim may be achieved by as an elastic member absorbing collision impact and being compressed when the vane collides with the shroud segment due to expansion of the vane. The technical problems to be achieved by the present disclosure are not limited to the technical problems mentioned above, and other technical problems not mentioned can be clearly understood by those having ordinary skill in the art to which the present disclosure belongs from the description below.

One embodiment is a compressor, including: a casing; a retaining ring coupled to an inside of the casing; a plurality of vanes fastened to an inner circumferential surface of the retaining ring and spaced apart from each other along a circumferential direction of the retaining ring; a diffuser fixed to face an end of a rotor disk installed in an inner space of the casing; a shroud segment movably disposed on the diffuser to face at least one of the plurality of vanes; and an elastic member installed between the shroud segment and the diffuser.

According to the embodiment, a plurality of dovetail grooves formed to be spaced apart from each other in a circumferential direction may be provided on an inner circumferential surface of the retaining ring, and each of the plurality of vanes may include a dovetail portion fastened to the dovetail grooves; and a wing portion extending from the dovetail portion in a radial direction of the retaining ring.

According to the embodiment, the dovetail portion may include a bottom surface opposing the wing portion; and a pair of tapered surfaces obliquely extending from the bottom surface toward the wing portion such that a width thereof is narrowed toward the wing portion.

According to the embodiment, the shroud segment may consist of a plurality of shroud segments continuously disposed along a circumferential direction of the diffuser, and the elastic member may be composed of a plurality of elastic members disposed between each of the plurality of shroud segments and the diffuser.

According to the embodiment, an engagement protrusion may be formed on one side in a circumferential direction of each of the plurality of shroud segments, and an engagement groove allowing the engagement protrusion of an adjacent shroud segment to be seated therein may be formed on another side in a circumferential direction thereof.

According to the embodiment, a catching protrusion may be formed in the shroud segment, a catching groove allowing the catching protrusion to be seated therein may be formed in the diffuser, and a width of the catching groove may be greater than a thickness of the catching protrusion such that the catching protrusion moves within the catching groove.

According to the embodiment, the shroud segment may include a main body disposed on the diffuser and a pair of leg portions extending from the main body toward the diffuser, and the catching protrusion may be comprised of a pair of catching protrusions, each of which protrudes outward in an axial direction from the pair of leg portions.

According to the embodiment, each of the pair of catching protrusions may protrude in a direction opposite to each other.

According to the embodiment, a sealing member may be interposed between the shroud segment and the diffuser.

According to the embodiment, a sealing member may be interposed between at least one of the pair of leg portions and the diffuser opposing the one of the pair of leg portions.

According to the embodiment, the compressor may further include: a positioning member having one end fixed to one among the shroud segment and the diffuser and another end movably disposed on the other one among the shroud segments and the diffuser.

According to the embodiment, one end of the positioning member may be fixed to the diffuser, and another end may be disposed in a groove portion formed in the shroud segment.

According to the embodiment, the elastic member may be located on an outside of the positioning member.

According to the embodiment, the positioning member may be a screw.

According to the embodiment, the elastic member may be a spring.

According to the embodiment, when the vane collides with or applies force to the shroud segment due to expansion of the vane during operation of the compressor, the elastic member may be compressed while absorbing force.

According to the embodiment, during operation of the compressor, a maximum length radially expandable of the vane may be smaller than a sum of a distance between the vane and the shroud segment and a distance at which the shroud segment is movable on the diffuser.

Another embodiment is a gas turbine, including: the compressor to suck and compress air to a high pressure according to any one among the above embodiments; a combustor to mix the air compressed by the compressor with fuel and combust the air-fuel mixture; and a turbine to generate power by rotating a turbine blade using high-temperature, high-pressure combustion gas discharged from the combustor.

ADVANTAGEOUS EFFECT

According to the present disclosure, the cantilever type is easy to manufacture and assemble, and when the vane collides with the shroud segment due to expansion of the vane, the elastic member absorbs the impact and is compressed, thereby minimizing the vane tip clearance. As a result, the leakage flow through the tip clearance can be minimized, so that aerodynamic performance can be maximized.

In addition, an axial gap between the shroud segment and the diffuser may be eliminated, and leakage may be prevented by interposing the sealing member.

The advantageous effects of the present disclosure are not limited to the above effects, and it should be understood to include all effects that can be inferred from the configuration of the disclosure described in the detailed description or claims of the present disclosure.

DETAILED DESCRIPTION

Figure 1:
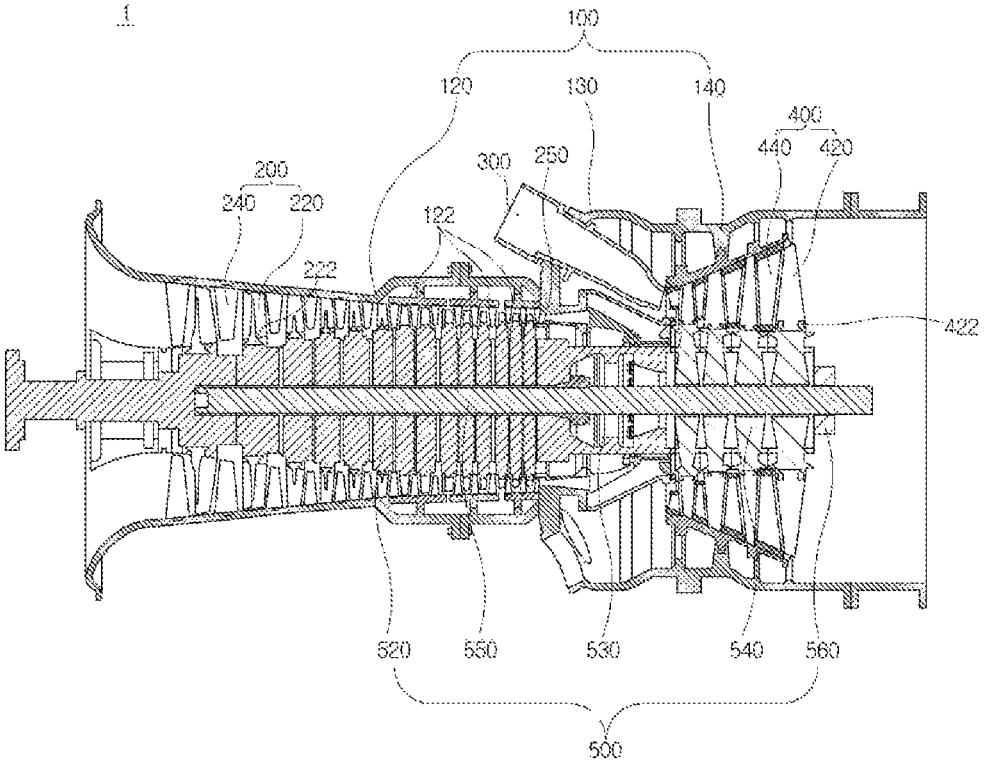
FIG. 1 is a cross-sectional view illustrating a gas turbine according to an embodiment of the present disclosure.

Hereinafter, exemplary embodiments of a compressor and a gas turbine of the present disclosure will be described with reference to the accompanying drawings.

In addition, the terms to be described later are terms defined in consideration of functions in the present disclosure, which may be changed according to intention or practices of a user or operator, and the examples below do not limit the scope of the present disclosure, but are merely illustrative of the components presented in the claims of the present disclosure.

In order to clearly explain the present disclosure in the drawings, parts irrelevant to the description are omitted, and the same reference numerals will be used to refer to the same or similar elements throughout the specification. In addition, throughout the specification, unless explicitly described to the contrary, when a component includes/comprises a certain element, the words "include/comprise" will be understood to imply the inclusion of other elements but not the exclusion of any other elements.

First, the configuration of a gas turbine according to an embodiment of the present disclosure will be described with reference to FIG. 1.

A gas turbine 1 according to the present disclosure includes, largely, a casing 100, a compressor 200 to suck and compress air to a high pressure, a combustor 300 to mix the air compressed by the compressor 200 with fuel and combust the mixture of the fuel and the air, and a turbine 400 to rotate a rotor 500 and generate power by rotational force using combustion gas discharged from the combustor 300.

The casing 100 may include a compressor casing 120 in which the compressor 200 is accommodated, a combustor casing 130 in which the combustor 300 is accommodated, and a turbine casing 140 in which the turbine 400 is accommodated. Here, the compressor casing 120, the combustor casing 130, and the turbine casing 140 may be sequentially arranged from an upstream side to a downstream side in terms of a fluid flow direction.

Inside the casing 100, a rotor 500 is rotatably provided by a bearing along a central axis of the gas turbine 1, and a generator (not illustrated) is interlocked to the rotor 500 to generate power.

The rotor 500 includes a compressor rotor disk 520 accommodated in the compressor casing 120, a turbine rotor disk 540 accommodated in the turbine casing 140, and a torque tube 530 accommodated in the combustor casing 130 and connecting the compressor rotor disk 520 and the turbine rotor disk 540. The rotor 500 may further include a tie rod 550 and a fixing nut 560 that fasten the compressor rotor disk 520, the torque tube 530, and the turbine rotor disk 540.

A plurality of the compressor rotor disk 520 are formed (for example, 14 disk sheets), and the plurality of compressor rotor disks 520 may be arranged along an axial direction of the rotor 500. That is, the compressor rotor disk 520 may be formed in multiple stages (for example, 14 stages). In addition, each compressor rotor disk 520 may be formed in an approximate disk shape, and a compressor blade coupling slot may be formed on its outer periphery so that a compressor blade 220, to be described later, may be coupled thereto.

The turbine rotor disk 540 may be configured similarly to the compressor rotor disk 520. That is, a plurality of the turbine rotor disks 540 are formed, and the plurality of turbine rotor disks 540 may be arranged along an axial direction of the rotor 500. That is, the turbine rotor disk 540 may be formed in multiple stages. In addition, each turbine rotor disk 540 may be formed in an approximate disk shape, and a turbine blade coupling slot may be formed on its periphery so that a turbine blade 420, to be described later, may be coupled thereto.

The torque tube 530 is a torque transmission member that transmits rotational force of the turbine rotor disk 540 to the compressor rotor disk 520. One end of the torque tube 530 may be fastened to the compressor rotor disk located at a most downstream end in a flow direction of air among the plurality of compressor rotor disks 520, and the other end of the torque 530 may be fastened to the turbine rotor disk 540 located at a most upstream end in a flow direction of combustion gas among the plurality of turbine rotor disks 540. Here, projections are formed on the one end and the other end of the torque tube 530, respectively, and each of the compressor rotor disks 520 and the turbine rotor disks 540 has a protrusion and a groove meshing with the protrusion such that relative rotation of the torque tube 530 with respect to the compressor rotor disk 520 and the turbine rotor disk 540 can be prevented.

In addition, the torque tube 530 may be formed in a hollow cylinder shape such that air supplied from the compressor 200 passes through the torque tube 530 and flows to the turbine 400. At this time, the torque tube 530 may be formed to be resistant to deformation and twisting due to the characteristics of the gas turbine that is continuously operated for a long time, and may be formed to be easily assembled and disassembled for easy maintenance.

The tie rod 550 may be formed to penetrate the plurality of compressor rotor disks 520, the torque tube 530 and the plurality of turbine rotor disks 540. One end of the tie rod 550 may be fastened into the compressor rotor disk located at a most upstream end in a flow direction of air among the plurality of compressor rotor disks 520. The other end of the tie rod 550 may protrude through an opposite side of the compressor 200 toward the turbine rotor disk 540 located at a most downstream end in a flow direction of the combustion gas, and may be fastened to the fixing nut 560.

Here, the fixing nut 560 presses the turbine rotor disk 540 located at the downstream end toward the compressor 200 side, and as a result, the plurality of compressor rotor disks 520, the torque tube 530, and the plurality of turbine rotor disks 540 may be compressed in an axial direction of the rotor 500. Accordingly, axial movement and relative rotation of the plurality of compressor rotor disks 520, the torque tube 530, and the plurality of turbine rotor disks 540 may be prevented.

In the meantime, in the embodiment of the present disclosure, one tie rod is provided, but the present disclosure is not limited thereto. In other embodiments of the present disclosure, separate tie rods may be provided on the compressor side and the turbine side, respectively, or a plurality of tie rods may be radially arranged along a circumferential direction.

The compressor 200 may include the compressor blade 220 rotating together with the rotor 500 and a compressor vane 240 installed on the compressor casing 120 to align a flow of air drawn into the compressor blade 220.

A plurality of the compressor blade 220 may be formed. The plurality of compressor blades 220 may be formed in multiple stages along an axial direction of the rotor 500. The plurality of compressor blades 220 may be radially disposed along a rotational direction of the rotor 500 for respective stages. The rotational directional may be referred to as a circumferential direction throughout this specification. A root portion 222 of the compressor blade 220 is coupled to the compressor blade coupling slot of the compressor rotor disk 520. The root portion 222 may be formed in a fir-tree shape or a dovetail shape to prevent the compressor blade 220 from being separated from the compressor blade coupling slot in a radial direction of the rotor 500. At this time, the compressor blade coupling slot is formed to correspond to the root portion 222 of the compressor blade.

Here, the compressor rotor disk 520 and the compressor blade 220 may be generally coupled in a tangential type or an axial type scheme. In the embodiment of the present disclosure, the compressor blade root portion 222 is formed in a so-called axial type scheme in which the compressor blade root portion 222 is inserted into the compressor blade coupling slot along the axial direction of the rotor 500. Accordingly, in the present embodiment, a plurality of compressor blade coupling slots are formed and radially arranged along a circumferential direction of the compressor rotor disk 520.

A plurality of the compressor vane 240 are formed. The plurality of compressor vanes 240 may be formed in multiple stages along the axial direction of the rotor 500. Here, the compressor vane 240 and the compressor blade 220 may be alternately arranged along the air flow direction. In addition, the plurality of compressor vanes 240 may be disposed radially along the rotational direction of the rotor 500 for respective stages. In one embodiment, at least one of the plurality of compressor vanes 240 may be mounted to be rotatable within a predetermined range for the purpose of adjusting an inflow of air.

The combustor 300 creates a high-energy, high-temperature, high-pressure combustion gas by mixing air introduced from the compressor 200 with fuel and combusting the mixture of the air and fuel to generate a combustion gas. During this process, an isobaric combustion process may be performed to raise the combustion gas temperature to a heat resistance limit that the combustor and turbine can withstand. A plurality of the combustor 300 may be formed. The plurality of combustors 300 may be arranged along a rotational direction of the rotor 500 in a combustor casing 130.

Each combustor 300 includes a liner into which compressed air from the compressor 200 is introduced, and a transition piece positioned at a rear of the liner to guide combustion gas to the turbine 400. The liner and the transition piece form a combustion chamber therein, and a sleeve is arranged to surround the liner and the transition piece to form an annular flow space therebetween.

In addition, each combustor 300 may further include a fuel injection nozzle provided at a front of the liner to mix compressed air supplied from the compressor 200 and fuel and inject the mixture. Each combustor 300 may further include a spark plug provided in a wall portion of the liner to ignite the mixture of the compressed air and fuel in the combustion chamber. Afterwards, the burnt gas, which may be referred to as combustion gas, is discharged to the turbine 400 to generate rotation.

At this time, it is important to cool the liner and the transition piece exposed to the high-temperature and high-pressure combustion gas to increase the durability of the combustor. To this end, a cooling hole may be formed in the sleeve so that the compressed air flowing through the cooling hole vertically collides with an outer wall of the liner and the transition piece to cool the liner and the transition piece. Specifically, the compressed air introduced from the compressor 200 may flow into the annular space through the cooling hole formed in the sleeve, cool the liner and the transition piece, flow forward of the liner along the annular space, and flow into the fuel injection nozzle.

Here, a de-swirler serving as a guide vane may be formed between the compressor 200 and the combustor 300 so as to adjust a flow angle at which air is drawn into the combustor 300, to a designed flow angle.

Next, the turbine 400 may be configured in a manner similar to that of the compressor 200. The turbine 400 may include turbine blades 420 rotating together with the rotor 500 and turbine vanes 440 fixedly mounted to the turbine casing 140 to align a flow of air to be drawn onto the turbine blades 420.

A plurality of the turbine blades 420 may be formed. The plurality of turbine blades 420 may be formed in multiple stages along the axial direction of the rotor 500, and the plurality of turbine blades 420 may be formed radially along a rotational direction of the rotor 500 for respective stages. A root portion 422 of the turbine blades 420 is coupled to the turbine blade coupling slot of the turbine rotor disk 540. The root portion 422 may be formed in a fir-tree shape or a dovetail shape. At this time, the turbine blade coupling slot is formed to correspond to the root portion 422 of the turbine blade.

A plurality of the turbine vanes 440 may be formed. The plurality of turbine vanes 440 may be formed in multiple stages along an axial direction of the rotor 500. Here, the turbine vanes 440 and the turbine blades 420 may be alternately arranged along the air flow direction. In addition, the plurality of turbine vanes 440 may be disposed radially along a rotational direction of the rotor 500 for respective stages.

Here, unlike the compressor 200, the turbine 400 is in contact with high-temperature and high-pressure combustion gas, so the turbine 400 requires a cooling unit to prevent damage such as thermal deterioration. To this end, the turbine 400 may include a cooling passage for bleeding compressed air from some parts of the compressor 200 and supplying the compressed air to the turbine 400. Depending on the embodiment, the cooling passage may extend from an outside of the casing 100 (external passage) or may extend by penetrating an inside of the rotor 500 (internal passage), or both the external and internal passages may be used.

At this time, the cooling passage may communicate with a turbine blade cooling passage formed inside the turbine blade 420, so that the turbine blade 420 can be cooled by cooling air. In addition, the turbine blade cooling passage may communicate with the turbine blade film cooling hole formed on a surface of the turbine blade 420, so that the cooling air is supplied to the surface of the turbine blade 420. Thereby, the turbine blade 420 may be, so-called, film-cooled by the cooling air. Similar to the turbine blades 420, the turbine vanes 440 may also be formed to be cooled by receiving cooling air from the cooling passage.

Here, the above gas turbine is merely one embodiment of the present disclosure. Now, embodiment of the compressor of the present disclosure will be described more in detail below. It is understood that the embodiment of the compressor of the present disclosure may be widely applied to jet engines in which air and fuel are combusted as well as to general gas turbines.

Next, referring to FIGS. 2 to 5, the compressor 200 according to the embodiment of the present disclosure is described. In particular, a structure in which the compressor vane 240 of the last stage of the compressor is installed will be described as an embodiment of the present disclosure.

Figure 3:
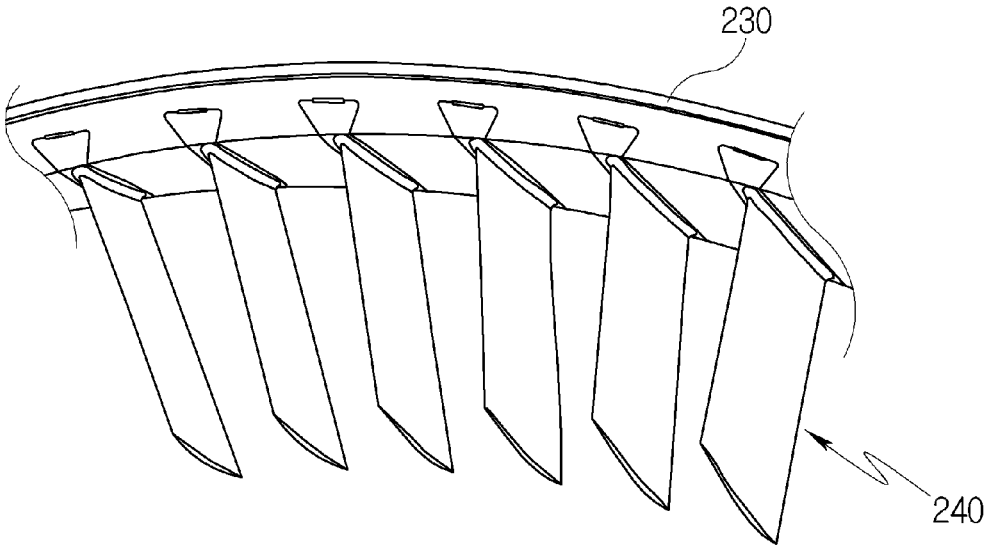
FIG. 3 is a perspective view illustrating a retaining ring and a compressor vane, separated in a coupled state in FIG. 1.

As illustrated in FIG. 3, the plurality of compressor vanes 240 is disposed at respective stages of the compressor 200. The plurality of compressor vanes 240 are fastened to an inner circumferential surface of the retaining ring 230 along a circumferential direction of the retaining ring 230, and are spaced apart from each other.

To this end, according to an embodiment, a plurality of dovetail grooves 232 formed to be spaced apart from each other along a circumferential direction are provided on an inner circumferential surface of the retaining ring 230. In addition, each of the plurality of compressor vanes 240 includes a dovetail portion 242 fastened to the dovetail groove 232 and a wing portion 244 extending in a radially inward direction of the retaining ring 230 from the dovetail portion 242. The wing portion 244 may be referred to, alternatively, as an airfoil portion 244.

Specifically, according to an embodiment, each of the dovetail portions 242 may include a bottom surface 242*a* opposing the wing portion 244 and tapered surfaces 242*b* on both sides extending toward the wing portion 244 while facing each other, but extending obliquely toward each other such that a width of the dovetail portions 242 is narrowed toward the wing portion 244. Accordingly, the dovetail portion 242 of each compressor vane may be fitted into and fastened to the dovetail groove 232 of the retaining ring, and be fixed so as not to be separated in a radial direction of the retaining ring 230. The dovetail portion 242 of each compressor vane may be inserted into the dovetail groove 232 in an axial direction of the rotor 500.

Figure 2:
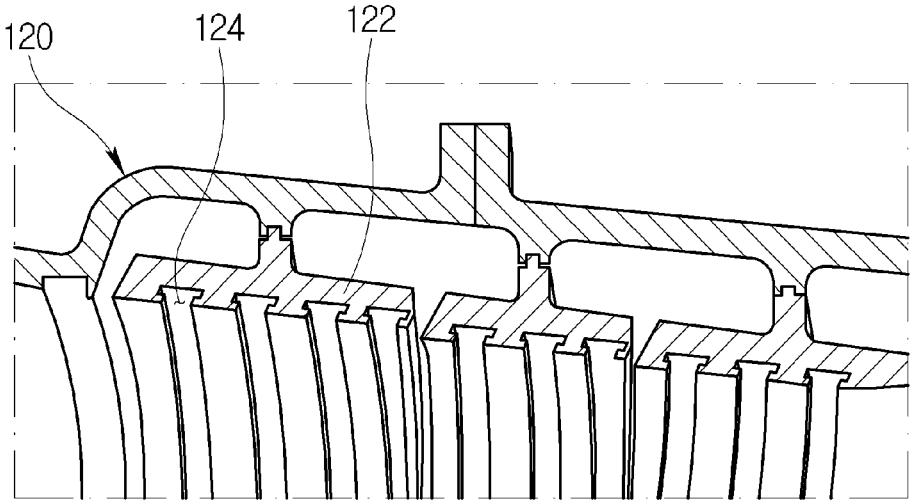
FIG. 2 is a perspective view of an enlarged portion of a compressor casing and a vane carrier illustrated in FIG. 1.

In addition, the retaining ring 230 of each stage may be directly or indirectly coupled to an inside of the compressor casing 120. As illustrated in FIG. 2, according to an embodiment, one or more vane carriers 122 are installed inside the compressor casing 120. The retaining ring 230 disposed at a front stage of the compressor may be directly coupled to an inside of the compressor casing 120, and the retaining ring 230 disposed at a rear stage of the compressor may be indirectly coupled to an inside of the compressor casing 120 via the vane carrier 122. To this end, a retaining engagement groove 124 may be formed to engage the retaining ring 230 on an inner circumferential surface of the compressor casing 120 or the vane carrier 122. The retaining ring 230 may be formed to have a cross section having a shape corresponding to the retaining engagement groove 124 such that the retaining ring 230 can be fitted into and engaged with the retaining engagement groove 124.

Figure 4:
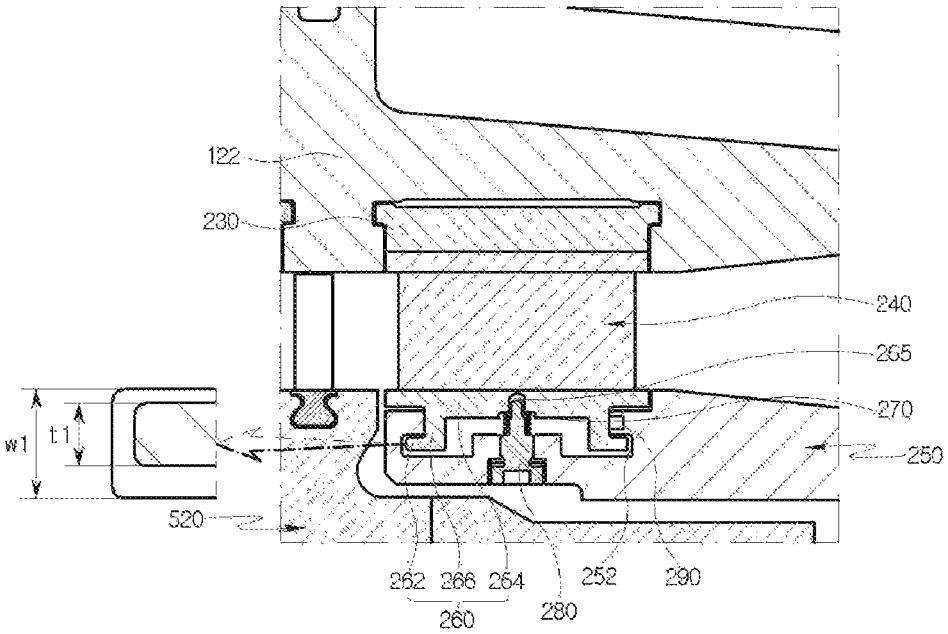
FIG. 4 is a cross-sectional view of an enlarged end of a compressor in the gas turbine of FIG. 1.

As illustrated in FIG. 4, according to an embodiment, radial inner ends (i.e., tips) of the plurality of compressor vanes 240 disposed at the last stage of the compressor oppose the diffuser 250. The diffuser 250 may be disposed radially outward of the torque tube 530, and be fixed at a predetermined interval so as to face an end of the compressor rotor disk 520. That is, the compressor rotor disk 520 rotates while the diffuser 250 does not rotate. The diffuser 250 serves to guide compressed air from the compressor 200 to the combustor casing 130 by connecting an outlet of the compressor 200 and an inlet of the combustor casing 130 in which the combustor 300 is disposed.

Figure 5:
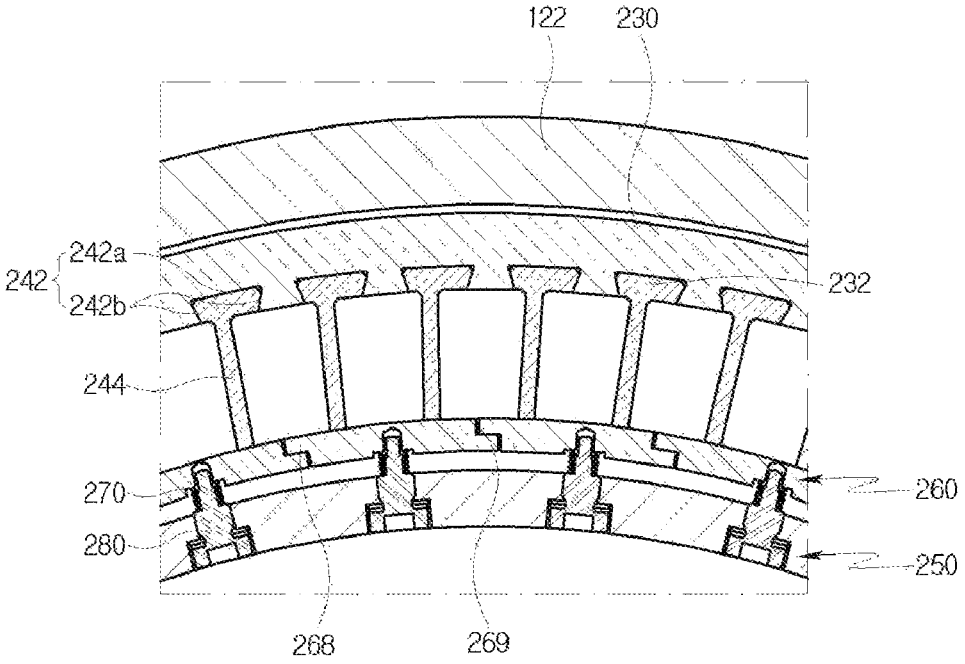
FIG. 5 is a cross-sectional side view of FIG. 4.

According to an embodiment, the shroud segment 260 is movably disposed on the diffuser 250, and the shroud segment 260 faces at least one compressor vane 240 among the plurality of compressor vanes 240. As illustrated in FIG. 5, according to an embodiment, a plurality of shroud segments 260 are continuously arranged along a circumferential direction of the diffuser 250, and each shroud segment 260 faces two compressor vanes 240. At this time, the shroud segments 260 adjacent to each other may be in meshing engagement to each other. That is, in each of the plurality of shroud segments 260, an engagement protrusion 268 may be formed on one side in a circumferential direction facing the adjacent shroud segment, and an engagement groove 269 on which the engagement protrusion 268 can be seated is may be formed on the other side in the circumferential direction. The shape of the engagement protrusion 268 may be formed to correspond to the engagement grove 269. Accordingly, the engagement protrusion 268 formed on one side of the shroud segment 260 in the circumferential direction may be seated and engaged with the engagement groove 269 formed on the other side of the adjacent shroud segment 260 in the circumferential direction.

In addition, as illustrated in FIG. 4, according to an embodiment, a pair of catching protrusions 262 protruding outward in an axial direction are formed on the shroud segment 260, and a pair of catching grooves 252 on which the pair of catching protrusions 262 are seated are formed on the diffuser 250. In particular, a width w1 of the catching groove 252 in the radial direction may be larger than a thickness t1 of the catching protrusion 262 in the radial direction, so that the catching protrusion 262 may be movable in a vertical direction in FIG. 4, i.e., the radial direction, within the catching groove 252.

More specifically, according to an embodiment, the shroud segment 260 may include a main body 264 disposed on the diffuser 250, a pair of leg portions 266 extending from the main body 264 toward the diffuser 250, i.e., toward a radially inward direction, and the pair of catching protrusions 262 at each of the radially inward ends of the pair of leg portions 266, each of which protruding from the pair of leg portions 266 toward the axial direction. Here, the pair of catching protrusions 262 protrude in opposite directions from each other, thereby obtaining structural stability and reducing vibration. In other words, one of the pair of catching protrusions 262 protrudes in the upstream direction and the other of the pair of catching protrusions 262 protrude in the downstream direction.

According to an embodiment, an elastic member 270 is installed between the shroud segment 260 and the diffuser 250 opposing to the shroud segment 260. The elastic member 270 may be disposed between the shroud segment 260 and the diffuser 250 in the radial direction. The elastic member 270 may apply pushing force against the shroud segment 260 and the diffuser 250, pushing them away from each other. In other words, the elastic member 270 may apply a force pushing the shroud segment 260 in the radially outward direction. In this embodiment, since a plurality of the shroud segments 260 are formed, a plurality of the elastic member 270 may also be formed and disposed between each of the plurality of shroud segments 260 and the diffuser 250. According to an embodiment, the elastic member 270 may be formed as a spring.

According to an embodiment, a radially inner end of the compressor vane 240 and the shroud segment 260 are in contact with each other in a steady state or a minimum gap may be formed therebetween. This is because, when a minimum gap is formed between the radially inner end of the compressor vane 240 and the shroud segment 260, even if the compressor vane 240 collides with the shroud segment 260 due to expansion of the compressor vane 240 as temperature rises during operation, the elastic member 270 may be compressed and may absorb the shock. So, due to the elastic member 270, compressor vane 240 is not worn by the collision or contact between the shroud segment 260 and the compressor vane 240 and vibration due to such collision or contact does not occur or is minimized. Similarly, even when the radially inner end of the compressor vane 240 and the shroud segment 260 are installed in contact with each other, when the compressor vane 240 expands as the temperature rises during operation and the compressor vane 240 applies force to the shroud segment 260, the elastic member 270 may be compressed and absorb the force. Accordingly, according to embodiments of the present disclosure, even though the compressor vane is in the cantilever type having only retaining rings outside of the vane, the vane tip clearance can be minimized, and ultimately, a leakage flow through the tip clearance of the cantilever type can also be minimized, thereby maximizing aerodynamic performance. Therefore, embodiments of the present disclosure may achieve both advantages—an advantage of easy manufacturing and assembly and an advantage of minimized vane tip clearance.

Moreover, according to an embodiment, a sealing member 290 may be interposed between the shroud segment 260 and the diffuser 250. The sealing member 290 may be disposed between the shroud segment 260 and the diffuser 250 in the axial direction. In one embodiment, the sealing member 290 is interposed between at one of the leg portions 266 of the shroud segment and the diffuser 250 opposing the leg portion 266. Accordingly, an axial gap between the shroud segment 260 and the diffuser 250 may be eliminated and leakage may be prevented.

Furthermore, according to an embodiment, a positioning member 280 may be further provided, having one end fixed to one among the shroud segments 260 and the diffuser 250 and the other end movably disposed on the other one among the shroud segment 260 and the diffuser 250. In one embodiment, one end of the positioning member 280 is fixed to the diffuser 250, and the other end is movably disposed on the shroud segment 260. To this end in this embodiment, in the shroud segment 260, more specifically, in a lower portion of the main body 264 of the shroud segment 260, a groove portion 265 extending in a vertical direction in the figure may be formed, in other words, in a radially outward direction from an inner surface of the main body 264. So, according to this embodiment, while one end of the position member 280 is fixed to the diffuser 250, the other end of the positioning member 280 may be placed within the groove portion 265. Accordingly, when the shroud segment 260 moves along with compression and tension of the elastic member 270 in the radial direction, the position of the diffuser 250 may be maintained without being shaken. In one embodiment, the positioning member 280 may be formed as a screw and be coupled to a coupling hole of the diffuser 250 by screw coupling. According to an embodiment, the elastic member 270 formed as a coil spring may be positioned so as to be wound around at least a part of an outside of the positioning member 280.

However, the present disclosure is not limited to the above embodiment, and the positioning member 280 may be omitted. For example, without the positioning member, an elastic member formed as a plate spring may be installed between the shroud segment 260 and the diffuser 250 to obtain the same effect of the above embodiment.

In addition, as described above, the maximum length that the compressor vane 240 can radially expands is preferably smaller than a sum of a distance (i.e., clearance) between the compressor vane 240 and the shroud segment 260 and a distance at which the shroud segment 260 can move in the radial direction with respect to the diffuser 250. In other words, the distance between the compressor vane 240 and the shroud segment 260 and the distance at which the shroud segment 260 can move in the radial direction with respect the diffuser 250 may be configured to be larger than the maximum length that the compressor vane 240 can radially expands during the operation of the compressor. It is to ensure the elastic member 270 sufficiently absorb the force applied to the shroud segment 260, when the compressor vane 240 expands according to the temperature rise during compressor operation. In this embodiment, the distance at which the shroud segment 260 can move in the radial direction with respect to the diffuser 250 may be determined as the smallest value among a radial distance between the main body 264 of the shroud segment 260 and the diffuser 250 facing the main body 264, a radial distance between the catching groove 252 and the catching protrusion 262, and a radial distance between a radial distal end of the positioning member 280 and a radial distal end of the groove portion 265 radially corresponding to the radial distal end of the position member 280. If the distance between the main body 264 of the shroud segment 260 and the diffuser 250 facing the main body 264, the distance between the catching groove 252 and the catching protrusion 262, and the distance between a distal end of the positioning member 280 and a distal end of the groove portion 265 are all the same, the value may be decided as the distance at which the shroud segment 260 can move on the diffuser 250.

The present disclosure is not limited to the above-described specific embodiments and descriptions, and a person having ordinary skill in the art to which the present disclosure pertains may modify the present disclosure in various ways without departing from the gist of the present disclosure in the claims. Such modification is within the protective scope of the present disclosure. Also, it is noted that any one feature of an embodiment of the present disclosure described in the specification may be applied to another embodiment of the present disclosure.

What is claimed is:

1. A compressor, comprising:

a casing;

a retaining ring coupled to an inside of the casing;

a plurality of vanes fastened to an inner circumferential surface of the retaining ring and spaced apart from each other along a circumferential direction of the retaining ring;

a diffuser fixed to face an end of a rotor disk installed in an inner space of the casing;

a shroud segment movably disposed on the diffuser to face at least one of the plurality of vanes; and an elastic member installed between the shroud segment and the diffuser.

2. The compressor of claim 1, wherein a plurality of dovetail grooves formed to be spaced apart from each other in a circumferential direction are provided on an inner circumferential surface of the retaining ring, and wherein each of the plurality of vanes comprises a dovetail portion fastened to the dovetail grooves; and a wing portion extending from the dovetail portion in a radial direction of the retaining ring.

3. The compressor of claim 2, wherein the dovetail portion comprises a bottom surface opposing the wing portion; and a pair of tapered surfaces obliquely extending from the bottom surface toward the wing portion such that a width thereof is narrowed toward the wing portion.

4. The compressor of claim 1, wherein the shroud segment consists of a plurality of shroud segments continuously disposed along a circumferential direction of the diffuser, and wherein the elastic member consists of a plurality of elastic members disposed between each of the plurality of shroud segments and the diffuser.

5. The compressor of claim 4, wherein an engagement protrusion is formed on one side in a circumferential direction of each of the plurality of shroud segments, and an engagement groove allowing the engagement protrusion of an adjacent shroud segment to be seated therein is formed on another side in a circumferential direction thereof.

6. The compressor of claim 1, wherein a catching protrusion is formed in the shroud segment, a catching groove allowing the catching protrusion to be seated therein is formed in the diffuser, and a width of the catching groove is greater than a thickness of the catching protrusion such that the catching protrusion moves within the catching groove.

7. The compressor of claim 6, wherein the shroud segment comprises a main body disposed on the diffuser and a pair of leg portions extending from the main body toward the diffuser, and the catching protrusion consists of a pair of catching protrusions, each of which protrudes outward in an axial direction from the pair of leg portions.

8. The compressor of claim 7, wherein each of the pair of catching protrusions protrudes in a direction opposite to each other.

9. The compressor of claim 1, wherein a sealing member is interposed between the shroud segment and the diffuser.

10. The compressor of claim 7, wherein a sealing member is interposed between at least one of the pair of leg portions and the diffuser opposing the one of the pair of leg portions.

11. The compressor of claim 1, further comprising:

a positioning member having one end fixed to one among the shroud segment and the diffuser and another end movably disposed on the other one among the shroud segments and the diffuser.

12. The compressor of claim 11, wherein one end of the positioning member is fixed to the diffuser, and another end is disposed in a groove portion formed in the shroud segment.

13. The compressor of claim 11, wherein the elastic member is located on an outside of the positioning member.

14. The compressor of claim 11,
wherein the positioning member is a screw.

15. The compressor of claim 1,
wherein the elastic member is a spring.

16. The compressor of claim 1,
wherein when the vane collides with or applies force to the shroud segment due to expansion of the vane during operation of the compressor, the elastic member is compressed while absorbing force.

17. The compressor of claim 16,
wherein during operation of the compressor, a maximum length radially expandable of the vane is smaller than a sum of a distance between the vane and the shroud segment and a distance at which the shroud segment is movable on the diffuser.

18. A gas turbine, comprising:
the compressor to suck and compress air to a high pressure according to claim 1;
a combustor to mix the air compressed by the compressor with fuel and combust the air-fuel mixture; and
a turbine to generate power by rotating a turbine blade using high-temperature, high-pressure combustion gas discharged from the combustor.

* * * * *